US005913449A

United States Patent [19]

Branch et al.

[11] Patent Number: 5,913,449

[45] Date of Patent: Jun. 22, 1999

[54] FLEXIBLE TUBULAR CONTAINERS

[75] Inventors: Mark Graham Branch, Leicester, United Kingdom; Alan Andrew Baxter, Cincinnati, Ohio

[73] Assignee: Courtaulds Packaging Limited, Essex, United Kingdom

[21] Appl. No.: 08/716,719

[22] Filed: Sep. 16, 1996

[51] Int. Cl.[6] ..... B65D 35/00

[52] U.S. Cl. ..... 220/677; 222/107

[58] Field of Search ..... 220/677, 678, 220/666; 215/2, 900; 222/107

[56] References Cited

U.S. PATENT DOCUMENTS

| | | | |
|---|---|---|---|
| 3,356,263 | 12/1967 | Monroe | 222/107 |
| 3,465,917 | 9/1969 | Saeki | 222/107 |
| 3,599,837 | 8/1971 | Anderson | 222/107 |
| 4,011,968 | 3/1977 | McGhie et al. | 222/107 |
| 4,039,507 | 8/1977 | Paige et al. . | |
| 4,257,536 | 3/1981 | Hilmar | 222/107 |
| 4,792,061 | 12/1988 | Nisida . | |
| 5,656,346 | 8/1997 | Hirt | 222/107 X |

FOREIGN PATENT DOCUMENTS

| | | |
|---|---|---|
| 567216 | 11/1987 | Austria . |
| 1282926 | 4/1991 | Canada . |
| 0 052 555 | 5/1982 | European Pat. Off. . |
| 0 561 187 A1 | 9/1993 | European Pat. Off. . |
| 0 584 808 | 3/1994 | European Pat. Off. . |
| 1351143 | 5/1964 | France . |
| 84 35 372 | 1/1987 | Germany . |
| 2 148 906 | 6/1985 | United Kingdom . |
| 91/19763 | 12/1991 | WIPO . |
| WO 96/25341 | 8/1996 | WIPO . |

OTHER PUBLICATIONS

Brant, P. et al., "Surface Composition of Amorphous and Crystallizable . . . ", Macromolecules, vol. 29, No. 17, Aug. 12, 1996, pp. 5628–5634.

*Primary Examiner*—Steven Pollard
*Attorney, Agent, or Firm*—Nixon & Vanderhye P.C.

[57] ABSTRACT

A shoulder piece (31) for assembly to a flexible tube (15) to form a container (40) and which is made from a composition containing high density polyethylene and linear low density polyethylene. The shoulder piece (31) has an annular lip (35) on its external surface (37) for positioning proximate an end (46) of a respective tube (15) to be assembled to the shoulder piece 31.

15 Claims, 2 Drawing Sheets

FLEXIBLE TUBULAR CONTAINERS

FIELD

This invention relates a shoulder piece for use in the manufacture of flexible tubular containers formed from an assembly of a moulded shoulder piece and a tubular body, and to flexible tubular containers made therefrom.

BACKGROUND

A typical plastics tubular container for a paste material, such as toothpaste, is made by forming a flexible tube and cutting the tube to length, and then assembling the tube to an injection moulded shoulder piece with an outlet nozzle. The tube may be extruded or may be formed by shaping a flat plastics strip around a mandrel so that the longitudinal edges of the strip are brought together during the shaping process and are welded together as the strip is advanced. The tube formed in this manner is typically substantially round or oval in cross-section and one end of the tube has a shoulder piece with an outlet nozzle welded thereto and the other end of the tube will be closed, after filling of the tube, in a sealed 'fish-tail' type end.

When the tubular body is formed from laminate strip, which is typically 300 microns (0.012") thick, the overlapping edges of the strip form irregularities in the thickness of the sidewall where they overlap, together with a step on both the internal and external surfaces of the tube. The known tube shoulder pieces are formed from a high density polyethylene material typically having a melt flow index in the range of 4–10, and the tube formed from the laminated strip typically comprises an aluminium foil barrier layer having an adhesive tie layer on each side thereof, with at least one layer of a polyethylene material over each adhesive layer. The tube is welded to the shoulder piece using high frequency welding techniques. In some cases the welds may be imperfect and this is in part due to the irregularities in the tube as previously described, which may cause problems in the welding of the moulded Shoulder to the tubular body. Defects frequently occur in the area where the overlapping edges are welded to the shoulder piece.

An increase in pressure applied during welding, or in the electrical power used in the welding process may improve the integrity of the welds produced and reduce the reject rate but unfortunately produce an assembly of inferior aesthetic appearance.

OBJECT OF INVENTION

The present invention provides a moulded shoulder piece for assembly to a flexible tubular body and which gives an improvement in the integrity of the welds between the flexible tubular body and the shoulder, with a consequent reduction in reject rate.

STATEMENTS OF INVENTION

According to a first aspect of the invention there is provided a shoulder piece for assembly to a flexible tube to form a container and -which is moulded from a composition of high density polyethylene and linear low density polyethylene, the shoulder having an external surface with an annular lip formed thereon for positioning proximate an end of a respective tube on assembly to the shoulder.

The term 'linear low density polyethylene' (LLDPE) means polyethylene made by the Ziegler-Natter process with an octane, butane or hexane comonomer and having a relative density in the range of 0.915 to 0.94.

The 'shoulder piece' has an improved weld integrity as compared with the 100% high density polyethylene (HDPE) shoulder.

The integrity of the welded containers is measured by checking the containers for air leaks. The percentage of containers that have air leaks is substantially reduced by the inclusion of LLDPE in the HDPE moulding and by the provisions of the lip.

The proportion by weight of HDPE to LLDPE in the composition is preferably between 40:60% and 60:40% and the preferred range is 50:50%.

Above 60% by weight of LLDPE the barrier properties of the shoulder become unsuitable for certain applications such as the storage and dispensing of toothpaste, and below 40% LLDPE the improvement in the weld integrity as compared with a 100% HDPE shoulder only produces a marginal reduction in reject rate.

Preferably the linear low density polyethylene has a higher melt flow index, as measure by ASTM D1238, than the high density polyethylene.

The integrity of the welds can be further improved by further including at least one annular rib arranged concentrically with the lip and radially outwardly thereof so that after assembly to the flexible tube, the rib is overlaid by the tube.

There are preferably two or three concentric ribs having a height of about 0.002–0.004"(0.05–0.1 mm) and spaced about 0.015" apart (0.4 mm) .

The invention also provides for a tube container having a shoulder with a nozzle formed thereon and a tubular body welded to the shoulder, where the shoulder is of the type according to the first aspect of the invention.

The tubular body is made form laminated strip which is formed into a circular or oval shape.

According to yet another aspect of the invention there is provided a method of manufacture of a flexible tube container comprising a shoulder piece having a nozzle thereon, and a tubular body which is heat welded to the shoulder piece, wherein, in order to improve the reliability of the welded joint between the shoulder piece and body, the shoulder piece is made from a composition comprising a mixture of high density polyethylene and linear low density polyethylene and has an annular lip formed on its external surface which is positioned proximate the end of the respective tubular body when it assembled to the shoulder.

DESCRIPTION OF THE DRAWINGS

The invention will be described by way of example and with reference to the accompanying drawings in which;

FIG. 1A is a schematic view showing the manufacture of tubes for a container according to the present invention.

Figure 1:
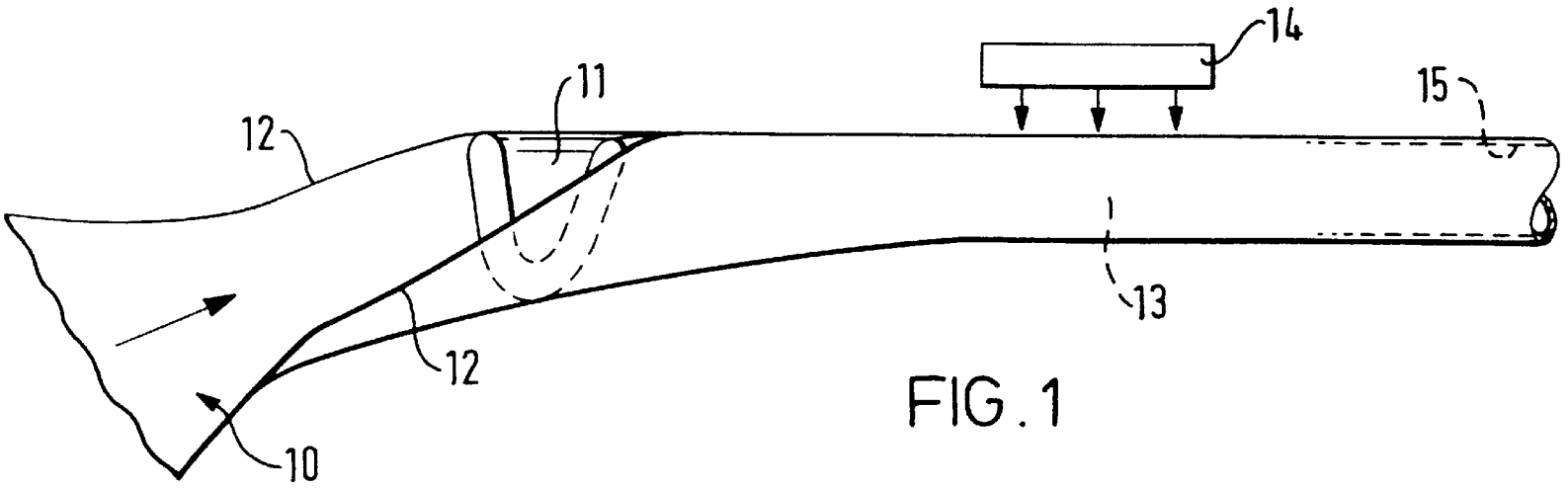
With reference to FIG. 1 there is shown, in schematic form, a process for the manufacture of toothpaste tubes from a flat flexible plastics strip 10 typically having a thickness of between 0.2 and 0.5 mm and more preferably 0.3 mm. The strip 10 is typically a laminate of several layers of different plastics materials including a vapour-impermeable barrier which may be a plastics material or a layer of aluminium foil.

The strip 10 is fed to a shaping funnel 11 which gradually brings the longitudinal edges 12 of the strip together with some overlap as the strip is advanced.

The rolled-up strip 10 passes over a generally cylindrical mandrel 13 and the overlapping edges 12 are welded together. For an aluminium foil laminate the welding process uses a high frequency welder 14, and for an all plastics laminate the welding process is by means of conductive heat using a continuous heated belt. The tube is then cut to length for assembly to form a flexible container.

Figure 2:
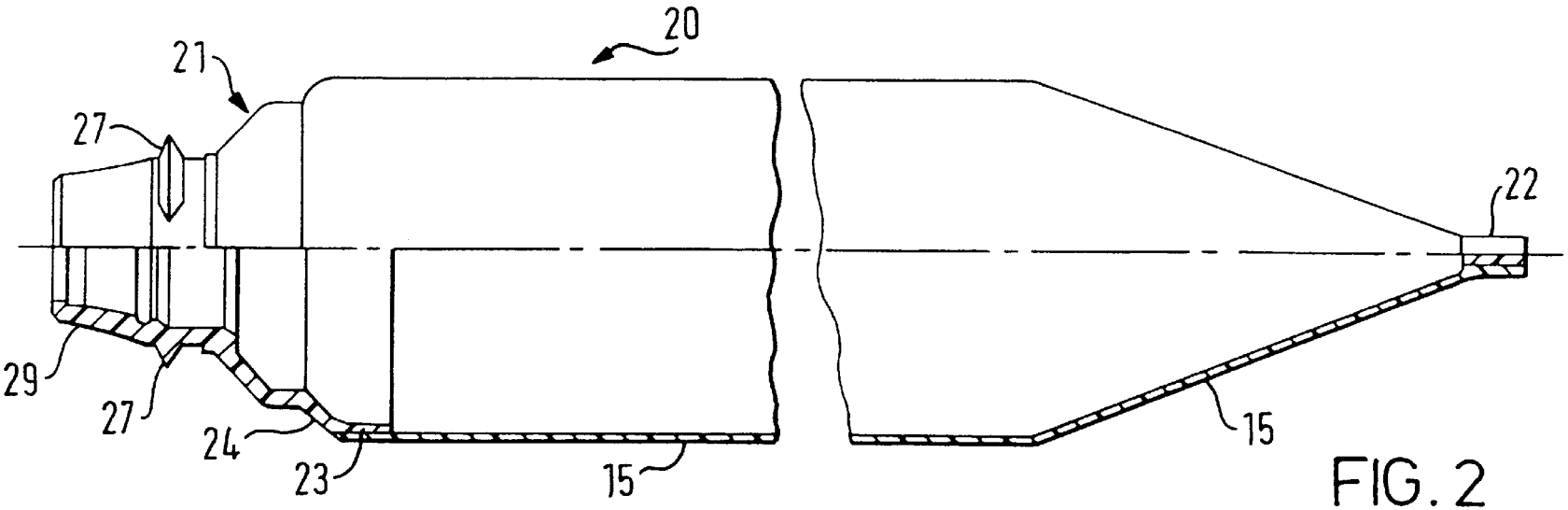
FIG. 2 (Prior Art)
FIG. 2 is a longitudinal view of a prior art flexible tube container shown without a cap and sectioned below the centre-line.

Referring now to FIGS. 2 there is shown a typical prior art container 20 in which the tube 15 has a shoulder piece 21 located at one open end of the tube 15. The other end of the tube 15 is closed, after filling the tube with the material (e.g. toothpaste) to be stored therein, in a fishtail type welded seam 22.

The shoulder piece 21 is suitably moulded in one piece from a high density polyethylene material having a melt flow index as measured by ASTM D1238 test procedure of between 4–10 and preferably about 5. Suitable materials are Quantum LS 40/40 available from Quantum Chemicals, and DSM 7108 available from DSM of the Netherlands The shoulder piece typically has a cylindrical sidewall 23 a frustoconical portion 24 extending inwardly from the sidewall 23, a central outlet nozzle 29, and a securing means for holding a cap (not shown) in place over the nozzle. The securing means may comprise a screw thread (see FIG. 3) or lugs 27 that act as part of a snap-on mechanism.

Figure 3:
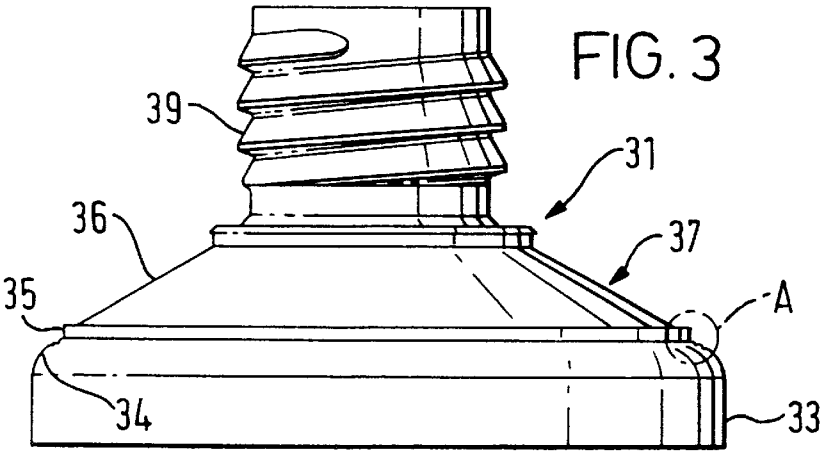
FIG. 3 is a side elevation of a shoulder piece according to the present invention.

A shoulder piece 31 according to the present invention is shown in FIG. 3. The shoulder piece 31 (sometimes referred to only as a shoulder) is similar to that described with reference to FIG. 2 and only the differences relating to the present invention will be described in detail. The shoulder piece 31 has a cylindrical sidewall 33 which extends radially inwardly through an arcuate shoulder 34 into a radially inwardly and axially outwardly extending frustoconical portion 36 which terminates in an outlet nozzle 39 which is screw threaded for engagement with a like threaded closure cap (not shown). The frustoconical portions may have any desired angle of inclination to suit but in this case is about 30°.

The frustoconical outer surface 37 of the shoulder piece 31, that is 'outer' with respect to the container, is formed with a raised step-like annular lip 35 adjacent the arcuate shoulder 34. The lip 35 is raised out of curved surface of the arcuate shoulder 34 by a height 'L' of about 0.035" (0.09 mm) and is slightly undercut in a reverse taper of about 10° so that the apex can overhang the end of the tube 15. The upper surface 39 of the lip projects out of the general plane of the surface 37 substantially horizontally for a distance D of about 0.024" (0.55 mm). Preferably the upper surface 39 is inclined at about 5°.

Figure 6:
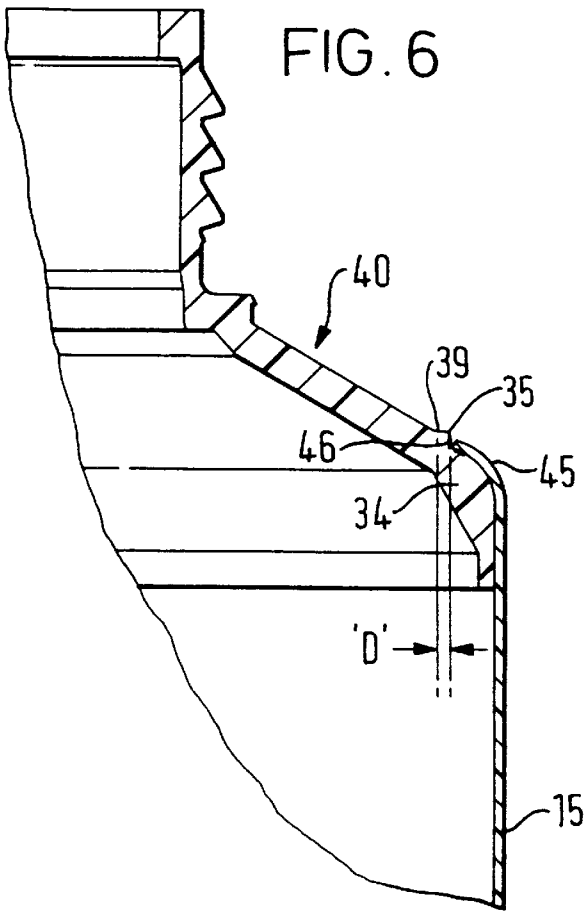
FIG. 6 is a cross-section of a shoulder and tube assembly according to the invention.

With reference also to FIG. 6, there is shown a tube container 40, also according to the invention, in which the lip 35 forms a reference for location of the end portion 45 of a tube 15. The end portion 45 of the tube 15 is formed around the arcuate shoulder 34 during assembly of the tube to the shoulder piece 31 so that its end 46 is proximate, and preferably in abutment with, the lip 35.

Figure 5:
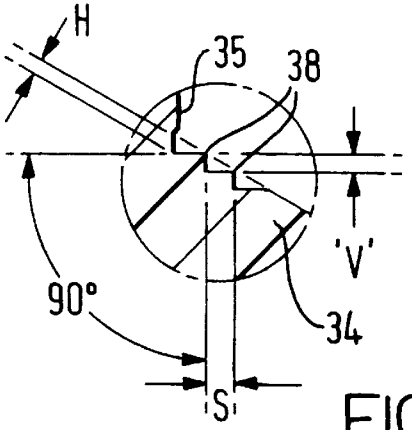
FIG. 5 is a further enlarged sectional view also taken in the encircled area showing only the external surface of the shoulder.
Figure 4:
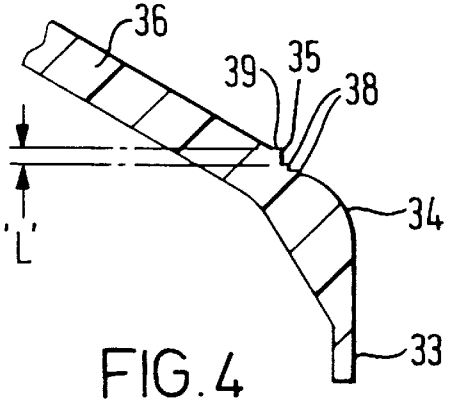
FIG. 4 is a part radial sectional view through the shoulder piece take in the encircled area A.

Adjacent the lip 35, and radially outwardly thereof, are a pair of concentric raised annular ribs 38. These ribs 38 are shown in detail in FIG. 5. The ribs are in the form of steps having horizontal and vertical surfaces 90° apart with the ribs having a vertical height V of between 0.002 0.005" (0.05 to 0.125 mm) and preferably about 0.004" (0.01 mm) and are spaced apart by a distance 'S' of about 0.007–0.008" (0.02 mm) so that the ribs 38 have a height H' of between 0.002–0.005" (0.05 to 0.125 mm) and about 0.004" (0.01 mm). The end portion 45 of the tube 15 overlies the ribs 38 during and after assembly. The shoulder piece 31 is formed by injection moulding a composition comprising between 40–60% by weight of high density polyethylene (HDPE) and 60–40% by weight of a linear low density (LLDPE).

The HDPE has a melt flow index of between 4–10 and a melting point of about 130–135° C., and the LLDPE has a melt flow index which is higher than that of the HDPE, and is preferably about 20, and a melting point in the range of 120–130° C. Suitable materials are for the HDPE Quantum LS 40/40, and for the LLDPE Quantum GA 564 both available from Quantum Chemicals. In the preferred embodiment the composition comprises 50/50 HDPE and LLDPE.

The tube 15, forming the body of the container, is formed from an aluminium foil laminate strip for example, James River 4200 laminate available from the James River Corporation or laminate strip TL 4315's' available from 4P Verpackungen Rohmsberg GbmH who are part of the Van Leer Group. The laminate is basically a layer of aluminium foil having an adhesive tie layer on each side with further layers of polyethylene on each side of the tie layers. The overall thickness of the laminate will be in the order of 200–450 microns, and preferably about 300 microns.

The laminate tubular body 15 is heat welded to the shoulder piece by high frequency welding techniques.

Leak Test

The assembled tube containers are tested for leaks by capping the respective containers and immersing the container in water, with container being held at 45°. The open end of the container is fitted with a combined air inlet and seal, and air at a pressure of 5 psi (approximate 0.4 bar) is blown into the closed open end of the tube and the pressure held for 3 seconds. If any air bubbles are detected then the tube is deemed to have failed the test.

Some 2400 (approximately) tube containers of the type shown in FIG. 6 were subject to the above leak test, and the percentage of defective containers was less than 0.1% of the containers tested.

This defect rate is considerably smaller than the defect rate for standard product tubes made from 100% HDPE shoulder pieces, or for shoulder pieces made from a mixed compound of HDPE and LLPDE but not including the annular lip 35, or the combination of the annular lip 35 and concentric ribs 38, on the external surface of the shoulder piece.

The improved weld integrity is believed to be due to the lower melting point, higher melt flow index LLPDE migrating to the surface of the shoulder pieces 31 during the injection moulding process. The lips 35 and ribs 38 therefore provide portions of the shoulder piece 31 made up of a high concentration of LLPDE which melts and flows more easily during the welding process, thereby more easily forming a weld of high integrity.

Whilst the invention has been described with reference to the use of foil laminate for manufacture of the tube, the invention is applicable to containers having flexible tubular bodies formed from laminate including a polymeric barrier layer such as a layer of ethylene vinyl alcohol.

For the all plastics laminate strip, the shoulder piece will be welded to the tubular body 15 using hot air to soften the plastics materials prior to fusion.

We claim:

1. An injection moulded shoulder piece for assembly by heat welding to a flexible tube to form a container, said shoulder comprised of:

a mixture of high density polyethylene and linear low density polyethylene, wherein said linear low density polyethylene has a higher melt flow index than the high density polyethylene, and said shoulder having an external surface with an annular lip formed thereon for positioning proximate to an end of said tube on assembly to the shoulder prior to said heat welding.

2. A shoulder piece as claimed in claim 1 wherein the shoulder is made from a composition comprising between 40–60% by weight HDPE and 60–40% by weight of LLDPE.

3. A shoulder piece as claimed in claim 2 wherein the composition comprises 50% HDPE by weight and 50% by weight LLDPE.

4. A shoulder piece as claimed in claim 3 and further including at least one annular rib arranged concentrically with the lip and radially outwardly thereof so that after assembly to the flexible tube the rib is overlaid by the tube.

5. A tube container having a shoulder piece with a nozzle formed thereon, and a tubular body which is welded to the shoulder wherein the shoulder piece is a shoulder piece as claimed in claim 4.

6. A tubular container as claimed in claim 5 wherein the tubular body is formed from laminated strip in which the strip is folded so that its longitudinal edges overlap, said edges being welded together forming a tube.

7. A tubular container as claimed in claim 6 wherein the laminate strip comprises a layer of aluminium foil having an adhesive tie layer on each side thereof, and at least one polyethylene layer on each outer side of the tie layer.

8. A shoulder piece as claimed in claim 1 and further including at least one annular rib arranged concentrically with the lip and radially outwardly thereof so that after assembly to the flexible tube, the rib is overlaid by the tube.

9. A shoulder piece as claimed in claim 8 wherein there are at least two concentric annular ribs.

10. A shoulder piece as claimed in claim 9 wherein the concentric annular ribs are spaced apart by about 0.007–0.008" (0.2 mm).

11. A shoulder piece as claimed in claim 8, wherein said at least one annular rib has a height of between 0.002"–0.004" (0.050–0.10 mm).

12. A tube having a shoulder piece with a nozzle formed thereon, and a tubular body which is welded to the shoulder, wherein the shoulder piece is a shoulder piece as claimed in claim 1.

13. A method of manufacture of a flexible tube container comprising a shoulder piece having a nozzle thereon, and a plastics tubular body, said shoulder piece is injection moulded from a composition comprising a mixture of high density polyethylene and linear low density polyethylene, wherein said linear low density polyethylene has a higher melt flow index than the high density polyethylene and has an annular lip formed on its external surface said method comprising the steps of:

assembling said tubular body on said shoulder with said annular lip which is positioned proximate the end of the respective tubular body when it is assembled to the shoulder; and heat welding said shoulder to said tubular body by at least melting a portion of said annular lip.

14. A method as claimed in claim 13 wherein the shoulder piece is further provided with at least one annular rib arranged concentricity with the lip and radially outwardly thereof, and the tubular body after assembly to the shoulder overlies the rib(s).

15. A method as claimed in claim 13 wherein the end of the tubular body is in abutment with the lip.

* * * * *